US005795604A

United States Patent [19]

Wells et al.

[11] Patent Number: 5,795,604

[45] Date of Patent: *Aug. 18, 1998

[54] RIGID RECLOSABLE BACON PACKAGE

[75] Inventors: Cindie M. Wells, Cambridge; Mark E. Selz, Sun Prairie, both of Wis.

[73] Assignee: Kraft Foods, Inc., Northfield, Ill.

[ * ] Notice: The term of this patent shall not extend beyond the expiration date of Pat. No. 5,520,939.

[21] Appl. No.: 652,178

[22] Filed: May 23, 1996

Related U.S. Application Data

[63] Continuation-in-part of Ser. No. 220,849, Mar. 31, 1994, Pat. No. 5,520,939.

[51] Int. Cl.[6] ..... B65D 85/62

[52] U.S. Cl. ..... 426/129; 426/106; 426/112; 206/471; 206/518; 206/815; 220/307; 220/516

[58] Field of Search ..... 426/106, 112, 426/119, 121, 124, 129, 396; 229/2.5 R; 220/307, 516; 206/518, 561, 564, 471, 815; 53/86

[56] References Cited

U.S. PATENT DOCUMENTS

| | | | |
|---|---|---|---|
| 2,995,269 | 8/1961 | Pease | 220/60 |
| 3,051,584 | 8/1962 | Tindall | 429/129 X |
| 3,101,864 | 8/1963 | Glickman | 270/60 |
| 3,326,408 | 6/1967 | Ringlen | 426/106 X |
| 3,454,158 | 7/1969 | Tigner | 426/129 X |
| 3,552,634 | 1/1971 | Ollier et al. | 229/43 |
| 3,650,386 | 3/1972 | Tigner | 426/129 X |
| 3,676,159 | 7/1972 | Fallowfied | 426/129 X |
| 3,792,181 | 2/1974 | Mahaffy et al. | 426/129 X |
| 3,803,332 | 4/1974 | Seiferth et al. | 426/129 X |
| 4,091,930 | 5/1978 | Buchner et al. | 206/605 |
| 4,857,342 | 8/1989 | Kappes | 426/107 |
| 4,873,101 | 10/1989 | Larson | 426/113 |
| 4,879,328 | 11/1989 | Morin et al. | 426/392 |
| 5,007,231 | 4/1991 | Ingemann | 53/472 |
| 5,044,495 | 9/1991 | Wyslotsy | 220/306 |
| 5,079,059 | 1/1992 | Wyslotsky | 428/43 |
| 5,092,479 | 3/1992 | Wells | 220/4.23 |
| 5,096,084 | 3/1992 | Wells | 220/337 |
| 5,131,551 | 7/1992 | Wells | 220/4.23 |
| 5,204,130 | 4/1993 | McDevitt et al. | 426/115 |
| 5,242,696 | 9/1993 | McDevitt | 426/129 X |
| 5,405,629 | 4/1995 | Marnocha et al. | 429/129 |
| 5,520,939 | 5/1996 | Wells | 426/129 |

FOREIGN PATENT DOCUMENTS

| | | |
|---|---|---|
| 506295 | 9/1992 | European Pat. Off. . |
| 1131629 | 10/1968 | WIPO . |

*Primary Examiner*—Milton Cano

*Attorney, Agent, or Firm*—Lockwood, Alex, Fitz-Gibbon & Cumming

[57] ABSTRACT

A shaped generally rigid, polymeric sealed package having an ordered set of bacon pieces is provided. The ordered pieces can be provided as multiple arrays of bacon strips, whether whole, partial or broken slices. Each array can include a plurality of bacon pieces with a flexible sheeting positioned between vertically adjacent bacon piece arrays. Corresponding slices from respective arrays are in general vertical alignment with each other so as to form multiple stacks of bacon pieces. A generally rigid cover or pedestal is releasably hermetically secured to a rigid tray or bubble. Package walls are substantially transparent so that the consumer can readily inspect, prior to purchase, multiple entire lengths of bacon slice surfaces. The package is especially advantageous when the bacon pieces are in the form of partially-to-fully-cooked slices or slice portions. The bacon pieces are supported in their ordered set configuration by engagement, directly or indirectly, with interior surfaces of the sealed package.

30 Claims, 3 Drawing Sheets

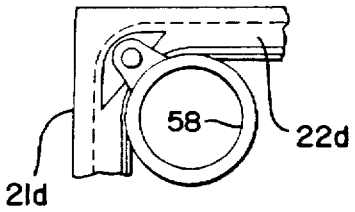
FIG. 10
FIG. 11
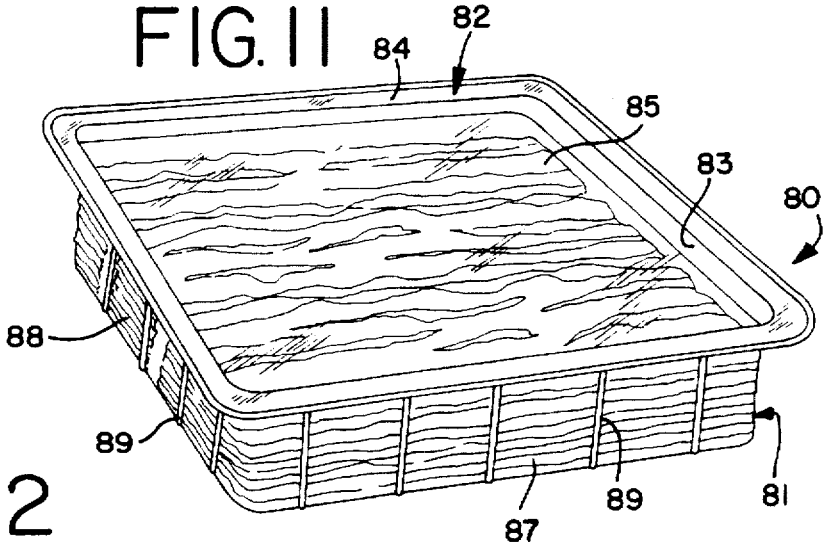
FIG. 12
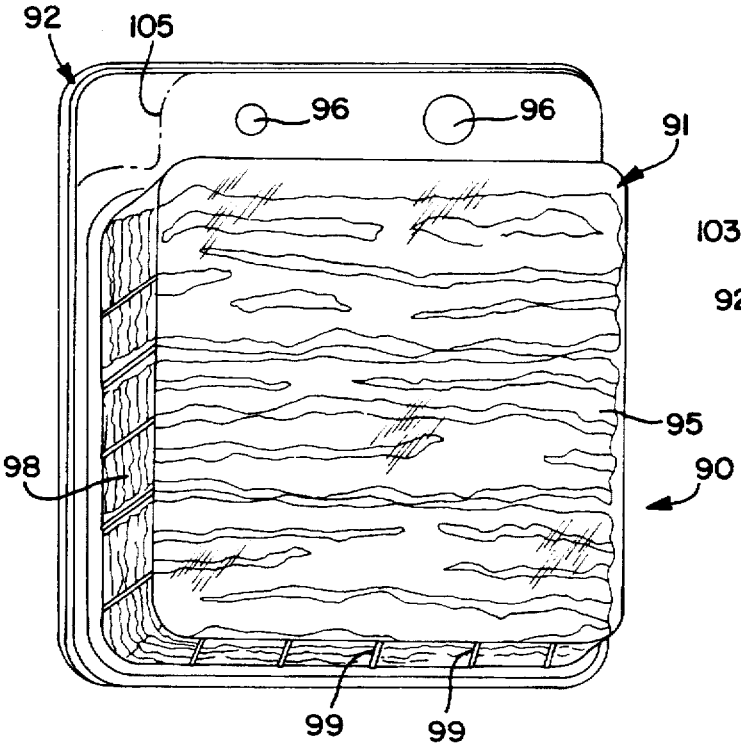
FIG. 13
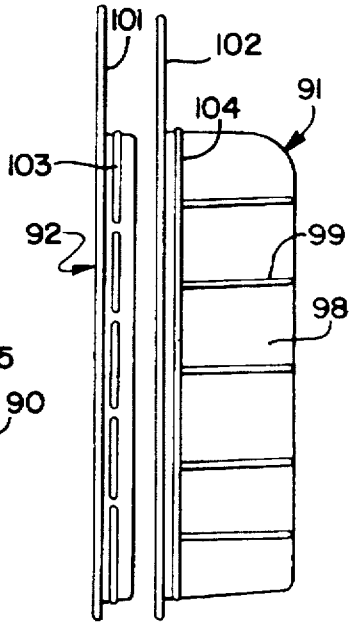

RIGID RECLOSABLE BACON PACKAGE

CROSS-REFERENCE TO RELATED APPLICATION

This is a continuation-in-part of application Ser. No. 08/220,849, filed Mar. 31, 1994, now Patent No. 5,520,939.

BACKGROUND AND DESCRIPTION OF THE INVENTION

The present invention generally relates to packaged bacon products, more particularly to hermetically sealed merchandising containers for multiple arrays of bacon slices which are containerized on top of one another and displayed such that a large portion of the total surface area of the bacon pieces is visible to the consumer prior to purchase. The invention makes it possible for the consumer to view multiple entire lengths of bacon slice edges or pieces and without shingling bacon slices. The package includes a tray (or bubble) and a cover (or pedestal), both of which are generally rigid and shaped prior to assembly together. The tray and cover preferably are hermetically sealed together in a releasable fashion, and they are openable and reclosable with respect to each other so as to provide relatively easy access to the bacon and easy reclosure after less than all of the bacon has been removed from the package. Partially or fully cooked bacon or raw bacon, whether provided as full-length slices or bacon pieces, is suitably packaged in accordance with the invention.

Bacon has long been available to retail consumers in sliced form, often within hermetically sealed packages. A typical package in this regard is a package containing approximately one pound of sliced bacon in a single shingled array which is hermetically sealed. Often, these packages are vacuum sealed. Typically, provision is made for viewing a portion of some of the shingled bacon slices. An example of such a bacon package is shown in Seiferth et al U.S. Pat. No. 3,803,332, incorporated by reference hereinto. Often, substantial portions of the bacon slices are obscured by a package of this type because it includes a so-called bacon board which is not transparent and which supports the shingled bacon during shipping, handling and in-home usage. Concerns are at times expressed by consumers that not enough surface area of the bacon slices is visible prior to purchase by the consumer. Consumers have expressed a concern that the "fatty" slices are intentionally hidden within the package, even though this is not a practical possibility in modern commercial-scale bacon processing operations.

Another concern which has at times been expressed by consumers is that bacon packages require the consumer's fingers to contact the packaging that has been exposed to the fat of the bacon in order to remove a bacon slice from the package. Usually, in order to gain access to a slice, the consumer must open and hold open a package panel or otherwise touch a part of the package which has a coating of fat on it. This fat contact can occur when opening the package, when accessing a previously opened package and/or when holding an open package during the course of removing a slice or slices therefrom.

Most current bacon packages hermetically seal the bacon slices within flexible films. This type of packaging can give an appearance which falls far short of that of a premium package. For example, the flexible film can loosely surround the bacon slices (especially in the case of a gas flushed package) or take on a loose or unstructured appearance once opened (in the case of flexible packages, including those which had been vacuum packaged). Also, many bacon packages are not truly reclosable in that they do not have positive means by which the package can be reclosed in order to securely contain the remaining bacon strips within the package once it has been opened and the bacon has been partially consumed.

In summary, the present invention provides reclosable bacon packaging that has a rigid tray or bubble for receiving the bacon and a rigid cover or pedestal that are hermetically sealed together and, once the hermetic seal is broken, the package is easily reclosed. The package offers a unique presentation of bacon strips or pieces. The bacon can be presented in two or more non-shingled arrays, each of which has bacon strips which are generally side-by-side of each. The package is gas flushed. Prior to opening, the two rigid package components are hermetically sealed to each other in an easy-release fashion. After having been opened, the two rigid package components are readily reclosed onto each other by a structure which preferably includes mating engagement between a peripheral inset surface and a peripheral surface that projects into and engages the peripheral inset surface.

It is accordingly a general object of the present invention to provide an improved shaped, generally rigid synthetic plastic bacon package.

Another object of the present invention is to provide an improved bacon package that is substantially entirely rigid or semi-rigid to the extent that the polymeric material of the package is formed and the package is reclosable.

Another object of this invention is to provide an improved bacon package that offers a unique presentation of bacon strips or pieces within rigid packaging in which every panel directly visible by the consumer prior to purchase can be transparent.

Another object of the present invention is to provide a rigid bacon package that is reclosable with a snap fit while affording easy product accessibility.

Another object of this invention is to provide a gas-flushed packaged bacon having both a rigid tray and a rigid cover, which package is reclosable and offers good product visibility and premium package appearance.

Another object of the present invention is to provide an improved packaged bacon wherein edges or faces of the slices or slice pieces are exposed and may be viewed from multiple package faces.

Another object of this invention is to provide an improved package for bacon, especially when uncooked, which minimizes contact between fatty coated package panels and the consumer's fingers when removing slices or pieces from the package.

Another object of this invention is to provide bacon packaging that is suitable for gas flushing to offer improved bacon piece separation and bacon piece removal from the package.

Another object of this invention is to provide improved bacon packages that are stackable or nestable one on top of the other so as to provide compact and secure stacking.

These and other objects, features and advantages of the present invention will be clearly understood through a consideration of the following detailed description.

BRIEF DESCRIPTION OF THE DRAWINGS

In the course of this description, reference will be made to the attached drawings, wherein:

FIG. 10 is a detailed plan view illustrating another embodiment of an easy-open feature;

FIG. 11 is a perspective view of a further embodiment having multiple bacon pieces in a gas-flushed environment;

FIG. 12 is a perspective view of a further embodiment in which bacon pieces for viewing are presented within a bubble; and FIG. 13 is an exploded side elevation view of the FIG. 12 embodiment.

DESCRIPTION OF THE PARTICULAR EMBODIMENTS

Figure 1:
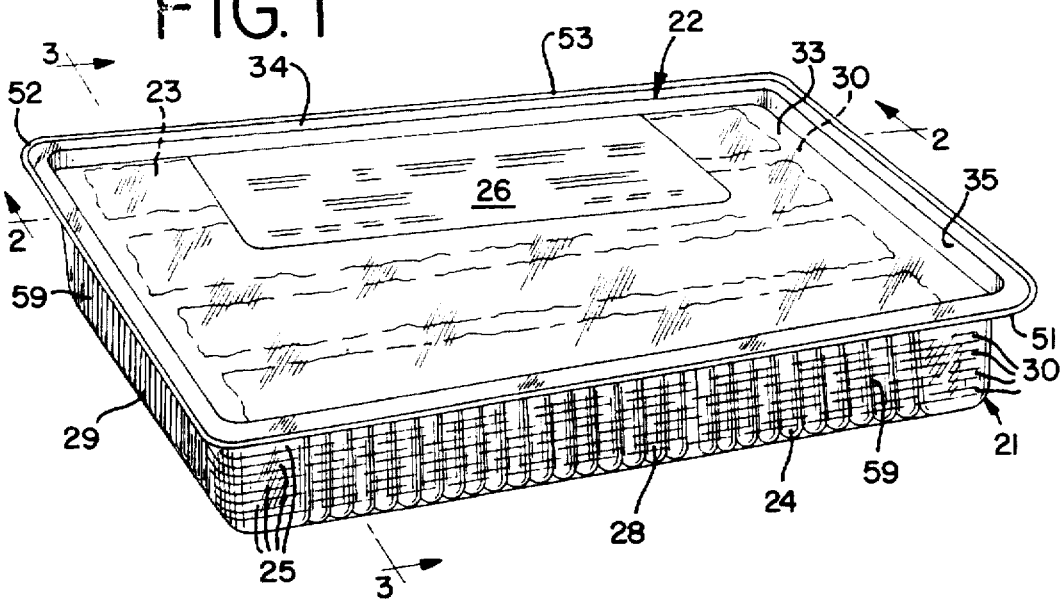
FIG. 1 is a perspective view of a sealed package in accordance with the present invention, showing multiple arrays of bacon slices sealed therewithin.
Figure 2:
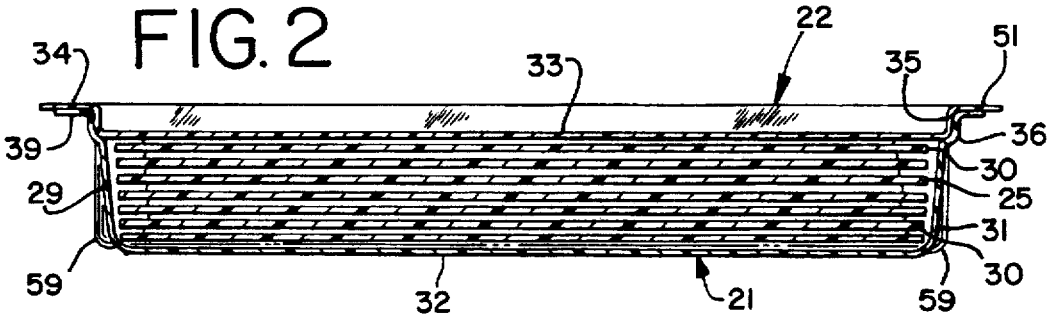
FIG. 2 is cross-sectional view along the line 2—2 of FIG. 1.
Figure 3:
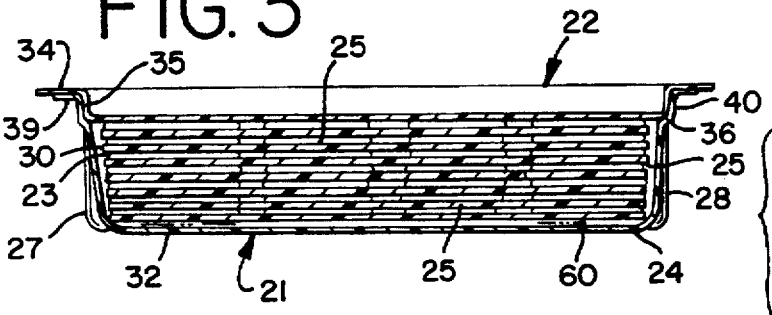
FIG. 3 is a cross-sectional view along the line 3—3 of FIG. 1.

A shaped, generally rigid synthetic plastic package for storing stacks of sliced bacon pieces in accordance with the present invention which is illustrated in FIGS. 1, 2 and 3 includes a tray member, generally designated as 21, and a cover or lid member, generally designated as 22. Both tray member 21 and cover member 22 are non-flexible film in that the film is semi-rigid or rigid and had been shaped or is shaped on-line, such as by suitable forming or heat molding techniques, into the shapes illustrated in the drawings which retain their respective shapes during normal handling. As thus shaped, they provide a somewhat protective and premium-appearing package for the bacon stacks. In these illustrated packages, two or more arrays 23, 24 of bacon pieces 25 are sealed therewithin, which pieces may be uncooked, partially cooked or fully cooked.

In this embodiment, the tray member 21 and the cover member 22 are transparent to the extent that the bacon therewithin can be readily viewed and inspected by a consumer prior to purchase. One or more label(s) 26 may be included in order to satisfy marketing and labeling needs and requirements. When desired one or more any such label can be itself transparent except, of course, for the message indicia that need to be opaque or translucent or contrasting in order to be visible to the consumer.

It will be appreciated that, in this embodiment, the bacon strip pieces 25 are in general vertical alignment with each other in each of the arrays 23, 24. Each strip within each array is laid out with respect to the other strips in the array such that they are conveniently spaced from each other along their respective longitudinal edges. Corresponding strips in vertically alternating respective arrays are generally in vertical alignment with each other. In this embodiment, they are shown having flexible sheeting 30 therebetween.

Sheeting 30 provides an especially neat appearance to the overall package and facilitates removal of a convenient quantity of bacon pieces, those which are in a given array, from the package as desired. Sheeting 30 is preferably a "grease resistant" material that will reduce grease or fat transfer out of the bacon and into the sheeting. Thus, the package maintains a neat appearance during storage. It should also be suitable for microwave use such that an entire array of bacon, for example, can be transferred from the package to the microwave. A preferred sheeting is parchment paper, another cellulosic material, or even non-cellulosic material.

In many instances, the entirety of the outwardly facing edges of each bacon slice 25 and both end edges of the slices in the arrays 23 and 24 are visible to the consumer prior to purchase by inspection through both longitudinal side panels 27, 28 and both tray end panels 29, 31 of the package. Furthermore, the entirety of the outwardly disposed or bottom surfaces of the bottom pieces of the stacks are visible through the tray bottom panel 32 when no sheeting is present. Even when a piece of sheeting 30 is below the bacon pieces of the bottom array, some indication of the condition of the pieces of this bottom array can be gained, depending upon the transparency or translucency of that sheeting. All or substantially all of the uppermost outwardly facing or top surfaces of the bacon pieces of the top array are visible through cover panel 33 of the cover portion 22. With this arrangement, more bacon piece surface is visible to the consumer prior to purchasing and opening the package of bacon in accordance with the present invention when compared with more traditional shingled bacon packages.

As illustrated, a cover panel 33 of the cover member 22 is inset or pedestal-like. More particularly, a peripheral flange 34 of the cover member is spaced away from the cover panel 33 by a peripheral inset portion 35. In this manner, the cover panel 33 projects into the tray member 21 when the package is in its closed condition. Peripheral inset portion 35 engages each of the longitudinal side panels 27, 28 and tray end panels 29, 31 of the tray member. Preferably this engagement is along a receptor portion of these tray panels. Illustrated in this regard is a peripheral ledge portion 36 positioned along the upper periphery of the sidewall of the tray member which is defined by side panels 27, 28 and end panels 29, 31. The peripheral end portion 40 of these side panels and end panels which is above or outside of the peripheral ledge portion 36 matingly receives peripheral inset portion 35 of the cover member in order to provide a reclosure feature.

Often, a tight fit or friction fit between the peripheral inset portion 35 of the cover member and the peripheral end portion 40 of the tray member will provide an adequate, positively acting reclosure feature by which the consumer has an audible acknowledgement and/or a tactile experience of closure completion by having a tight fitting arrangement wherein the location along the peripheral inset portion of the cover member is peripherally larger than the peripheral size of a location along the height of the peripheral end portion of the tray member. This aspect of the invention can be accentuated by proceeding with embodiments such as shown in FIG. 5 and/or in FIG. 6.

Figure 5:
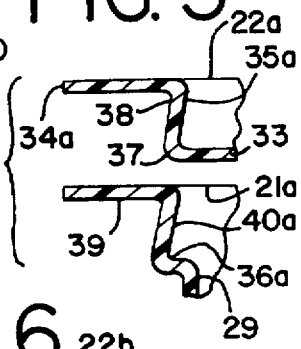
FIG. 5 is a partial sectional, exploded view showing an alternate snap-closure feature.
Figure 6:
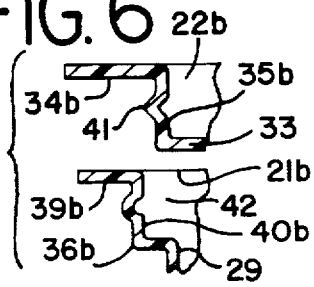
FIG. 6 is a partial sectional, exploded view showing an another snap-closure feature.

FIG. 5 illustrates a cover member 22*a* having a peripheral inset portion 35*a* which is tapered to the extent that the periphery of its lower portion 37 is greater than the periphery of its upper portion 38. Corresponding tray member 21*a* has a peripheral ledge portion 36*a* and a peripheral end portion 40*a* which generally corresponds in shape and angular offset to those of the peripheral inset portion 35*a*. When closed, flange 34*a* of the cover member 22*a* closely overlies and preferably engages flange 39 of the tray member 21*a* when the reclosure operation has been completed. FIG. 6 shows a cover member **22*b* having a peripheral inset portion 35*b* which includes a detent 41. A corresponding intent 42 is provided in the peripheral end portion 40*b* above the peripheral ledge portion 36*b***. A plurality of such indent and detent pairs can be provided along the periphery of the tray member and of the cover member, or the indents and detents can be continuous along the respective peripheries of the tray member and cover member. Any combination of these reclosure enhancing features can be included as desired, depending upon the extent of positive reclosability that is needed.

Figure 4:
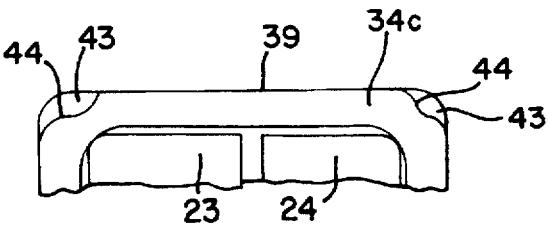
FIG. 4 is a detailed view of a portion of the package flange area showing an alternative easy-access opening feature.

In the FIG. 6 illustrated embodiment, at least a portion of the flange **39*b* of the tray member 21*b* is shorter than a corresponding portion of the peripheral flange 34*b* of the cover member 22*b*. This can be provided in order to facilitate separation of the cover member and the tray member. A reverse arrangement is also contemplated in which a portion of the tray member flange 39*b* is larger than and extends beyond a corresponding portion of the cover member flange 34*b*. As an example, the entirety of an end flange of the tray member can be shorter than the entirety of the end flange of the cover member, or vice versa. In another arrangement, this difference in the extent of the tray member flange and of the cover member flange can take the form of a digit grasping section 43 as generally illustrated in FIG. 4. As illustrated, the digit grasping section 43 is in the peripheral flange 39 of the tray member 39, while a cut-out 44 is provided in the peripheral flange 34*c*** of the cover member. Any combination of these various features for facilitating grasping by digital manipulation can be provided as desired.

An aspect of packages in accordance with this invention can be the inclusion of a hermetic sealing feature. This hermetic sealing feature has a peel ability aspect such that the package can be opened by the use of digital forces and without substantially distorting the cover member or lid member and/or its peripheral flange and/or the peripheral flange of the tray member. Depending upon the particular materials out of which the shaped tray member and lid or cover member are made, suitable sealants or adhesives can provide a suitable easily peeling or releasing hermetic seal. When the desired peel ability and hermetic sealing attributes can be attained without distortion of the packaging components during initial opening, no further sealing and opening means need be provided.

In other instances, the packaging materials and/or sealant or adhesive component make it difficult to formulate a combination of polymer and peelable sealant that will successfully withstand shipping and storage conditions and still open without unacceptably distorting or damaging the package, especially the lid member or the substantially mating respective peripheral flanges of the tray member and lid member. In those instances, the peelable sealing films or sealants are supplemented by a tear strip arrangement whereby the tear strip is pulled away in a peelable fashion and discarded, leaving an adequate peripheral flange on both the lid and the tray in order to achieve the reclosability features discussed herein.

Figure 7:
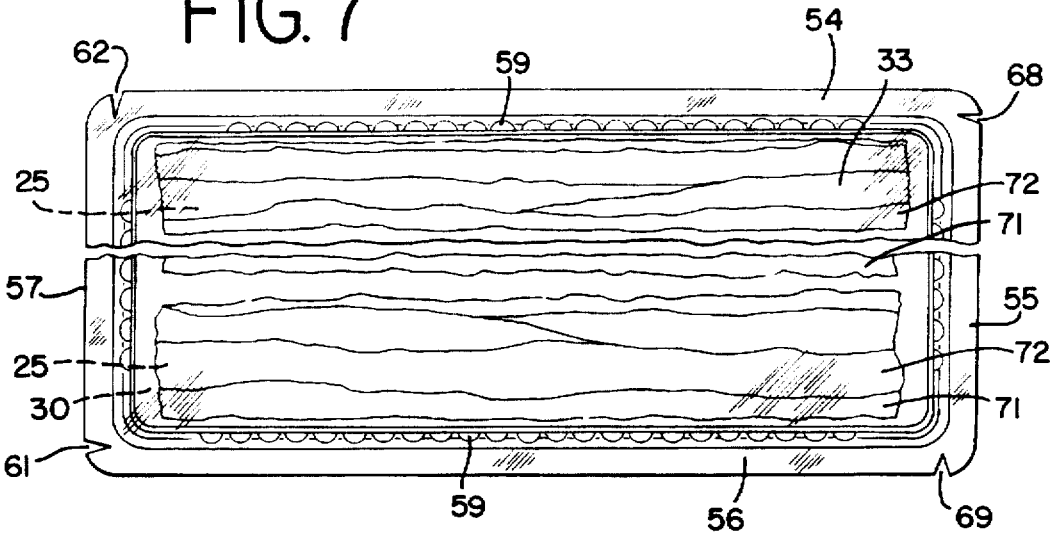
FIG. 7 is a top plan view, partially broken away, of an embodiment in accordance with the present invention showing an alternative easy-open feature.

FIG. 1 illustrates an embodiment wherein a peelable seal is assisted by a pull strip. In this instance, pull strip 51 peripherally surrounds the rest of the flange 34. In this illustrated embodiment, the pull strip runs for the entire periphery of the flange beginning at an initiation location 52. The illustrated pull strip includes a score line 53 to facilitate separation of the pull strip 51 from the rest of the flange. An illustrative pull strip including these general characteristics is described in U.S. Pat. No. 5,079,059, incorporated by reference hereinto. A similar arrangement is illustrated in FIG. 7 wherein a plurality of edge strips 54, 55, 56, 57 are removed by grasping at respective incisions 58, 59, 61, 62. General features of this type of tear strip arrangement are found in U.S. Pat. No. 4,091,930, incorporated by reference hereinto.

FIG. 10 illustrates an embodiment which incorporates a permanent seal that has an easy open feature by which cover member **22*d* is removed from tray member 21*d* by operation of a frangible component. The illustrated embodiment includes a pull ring 58 which, once lifted, breaks a permanent seal, such as under the pull ring 58. Thus opened, the pull ring 58 is used to easily peel the remainder of the cover member or lid member 22*d*** away from and off of the tray. Features along these lines are illustrated in U.S. Pat. No. 5,007,231, incorporated by reference hereinto.

Other peelable lid devices include those shown in U.S. Pat. No. 3,552,634, incorporated by reference hereinto, which shows a reusable lid which can require the use of a tool to open it. Another approach is found in U.S. Pat. No. 5,034,074, No. 5,160,391 and No. 5,240,133, also incorporated by reference hereinto.

Preferably, a plurality of wall ribs 59 are included in each longitudinal side panel 27, 28 and end panel 29, 31 of the tray member. For clarity, none are depicted in the side panel visible in FIG. 8. These ribs enhance the rigidity of the tray to prevent damage to the product during handling and to enhance the maintenance of the plurality of bacon pieces in their advantageously displayed orientation as shown in the drawings. Additionally, a rib 60 is preferably included within the bottom panel 32 of the tray. Rib 60 defines a biasing pedestal 70 which is raised and projects into the compartment of the package. This assists in providing adequate support for the weight of bacon within the package to thereby enhance the overall rigidity and premium characteristics of the tray member. The ribs can also help to facilitate flow of inert gas atmosphere within the package which is gas flushed with gases such as nitrogen, carbon dioxide and the like.

In addition to supporting the weight of the bacon, rib 60 helps to prevent buckling or sagging of the tray member due to pressure exerted on the stack of bacon pieces by the inside surface of the cover member when the height of the stack is such that the stack engages both the biasing pedestal 70 on the bottom inside surface of the tray member as well as the top inside surface of the cover member, even to the extent that compression of the bacon pieces can occur depending upon the particular height of the stack. In fact, in a preferred arrangement, the distance between the inside surface of the cover member and the top inside surface of the biasing pedestal 70 is equal to or less than the stack, measured prior to insertion of the stack into the package. When the stack is inserted and the package closed, there is thus engagement between the top of the stack and the cover member and between the bottom of the stack and the biasing pedestal. The recess formed by this pedestal arrangement can flex in response to product in the package, and the lid has the ability to bulge upwardly somewhat as well. This helps to maintain proper positioning of each bacon piece, even during shipment and handling prior to initial opening of the package.

The packages according to the invention are gas flushed. Gas flushed packaging improves slice separation and more easily accounts for slice size variations when compared with vacuum packaging which can experience package distortion, buckling and resultant leaking caused by size variations in the particular bacon pieces within any given package.

The combination including a gas flushed package, a wide-mouthed package with a peripheral flange, and a flanged lid that can be completely removed from the tray containing the stacked bacon allows the consumer to remove a piece or a desired number of pieces from the opened package without requiring the consumer's fingers to contact the inside surfaces of the tray, which can be laden with fat by virtue of extended contact with the bacon, especially when it is uncooked. A feature of the package is easy access to the bacon without having to contact surfaces of the packages that have fat residue thereon. It is even possible to thus easily and cleanly access the bacon with a suitable tool such as a fork, a spoon, or a pair of tongs and remove the bacon piece or pieces entirely from the package without any contact between the consumer's fingers and the bacon.

In addition, it will be noted that the peripheral flange 34, inset portion 35 and panel 33 of the cover member are preferably sized so as to accommodate reception of the bottom panel of the tray member of another package, including any rib positioned thereon. With this feature, the packages are nestable or stackable one onto to another so that the packages can be placed on top of one another without the package on top sliding off of the package below.

Figure 8:
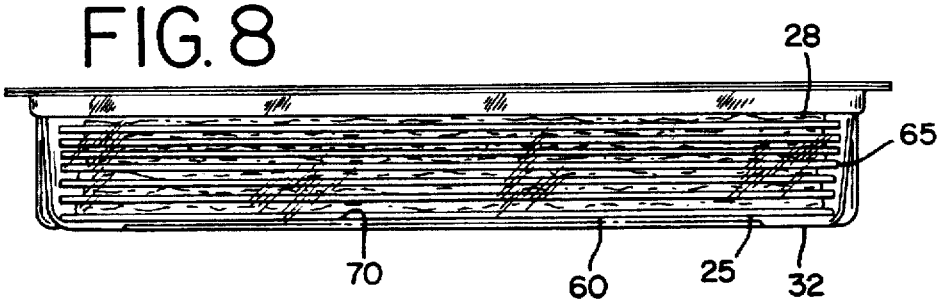
FIG. 8 is a side elevational view of the embodiment shown in FIG. 7.
Figure 9:
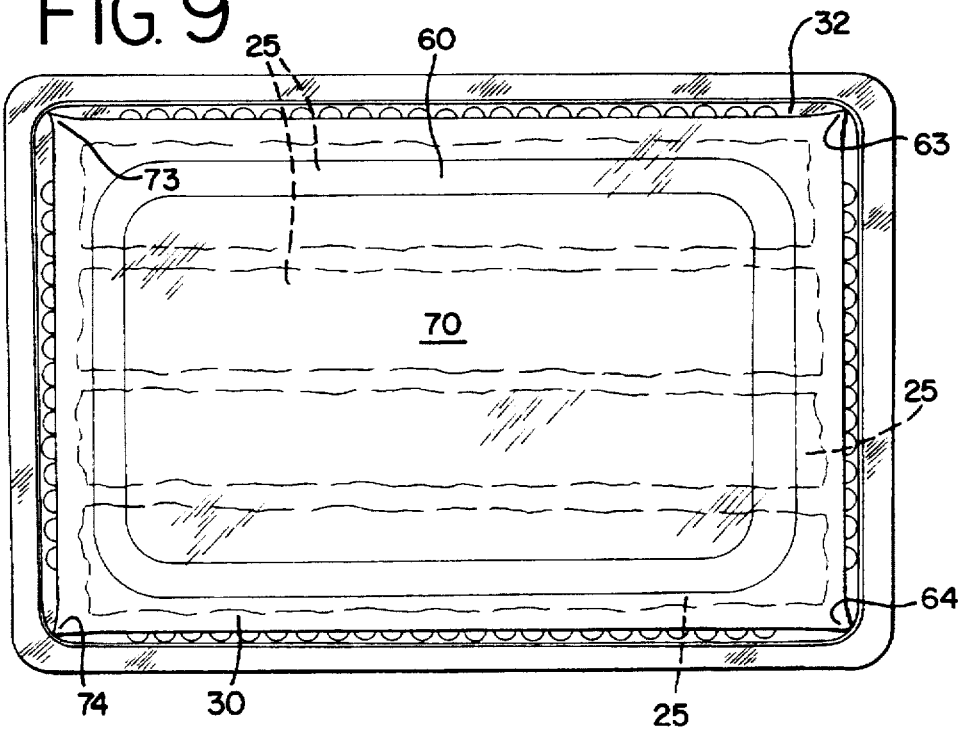
FIG. 9 is a bottom view of the package illustrated in FIG. 7.

An important aspect of the invention wherein multiple facets of the bacon pieces packaged in accordance with the present invention are visible through the packaging is further illustrated in FIGS. 7, 8 and 9. Both lean areas 71 and fat areas 72 are clearly visible through the cover panel 33 (when same is transparent) even when the package is fully sealed as shown in these drawings. Only labeling (see, for example, FIG. 1) would prevent easy inspection of the entirety of the top pieces as shown in FIG. 7. FIG. 8 illustrates that the entirety of the longitudinal edges 65 of bacon pieces 25 are readily inspected through the transparent longitudinal side panel 28 of the tray or bubble. The same is the case for the longitudinal side panel 27 of the tray. Each and every end edge of all of the bacon pieces are visible through tray end panel 31. The same is true for tray end panel 29. Accordingly, it will be appreciated that large portions of the surface area of several bacon pieces are visible to the consumer before the package is opened.

The embodiments shown in FIGS. 1–3 and 7–9, illustrate a plurality of arrays, each array including four full-length slices. This is for illustrative purposes. As a further example, if these four slices are substantially fully cooked, then a package of about the same size would accommodate only three partially cooked slices, and even more area would be taken up were the bacon to be fully uncooked. In some instances, the array of bacon slices will cover the entire area defined between the side panels 27, 28 and the end panels 29, 31.

With further reference to the sheeting 30 shown in some of the embodiments, each sheet can cover an area generally corresponding to that defined by a bacon array. In many instances, the area of the sheeting 30 is greater than the "footprint" of the bacon array, as is generally shown in the drawings. In some instances, the sheeting will fully fill the package area, including at corners 63, 64, 73, 74 of the sheeting, as visible in FIG. 9.

In another embodiment, such as illustrated in FIG. 11, half pieces of bacon are packaged to provide a generally square array of bacon. It will be noted that, in this embodiment, the package 80 also is generally square in horizontal cross-section. While half pieces are generally shown, pieces of different lengths, widths or other configurations can be thus packaged. Some may be of so-called sandwich length which can be longer than half length. Other bacon pieces may be of a broken or crumbled configuration. In any event, the bacon pieces will substantially fill the package and will typically engage all inside surfaces so that movement of the pieces will be controlled to minimize risk of damage to or mis-orientation of the pieces.

With further reference to FIG. 11, package 80 includes a tray member, generally designated as 81, and a cover or pedestal member, generally designated as 82, both having a construction and attributes such as similar components of the FIG. 1 package. Here the arrays of bacon pieces are not associated with sheeting, however. A plurality of wall ribs 89 are shown in each side panel 87, 88 of the tray member. The cover or pedestal member has a peripheral flange 84, an inset portion 83 and a panel 84 which are sized to accommodate reception of the bottom panel of the tray member of another such package, thereby rendering nestability to the packages.

The embodiment shown in FIG. 12 and FIG. 13 is especially well suited for displaying the bacon pieces in an orientation where the tray or bubble member 91 is oriented toward the consumer prior to purchase. Thus, this embodiment is especially suitable for a sales display at which each gas-flushed package 90 is hung from a peg or pegs, such as through opening(s) 96, which can be of the same or of different sizes as illustrated. A plurality of bacon pieces 95 are within the package as previously discussed, with the outer pieces engaging inside surfaces of the package so as to provide stable placement and support of the pieces irrespective of the actual shape or size of the pieces. In this regard, internal bacon pieces need not directly engage any wall of the package; however, even these pieces are supported in their proper place by pieces which they directly engage. Ribs 99 are provided in side panels 97, 98 of the bubble member 91.

In this embodiment especially, the cover or pedestal member 92 may be opaque inasmuch as the device for displaying the filled packages to the consumer will generally obscure the outside surface of the pedestal member 92, making transparency less useful. Such is the case whether the packages are hung on pegs or are supported on edge within a merchandiser, such as a self-facing merchandiser as shown in U.S. Pat. No. 4,907,707, No. 5,012,936 and No. 5,123,546, incorporated by reference hereinto.

The pedestal member 92 includes a header area 101 into which the hole(s) 96 may be located and on which labeling space is conveniently provided. A header area 102 also can be included on the bubble member 91. The respective header areas can be virtually the same area size, or one can be smaller or differently shaped to facilitate separation of the bubble 91 and the pedestal 92 in order to gain access to the bacon pieces inside. Either or both headers may extend for the entire width of the package. Alternatively, same may extend for only a portion of the width of the package, as generally illustrated in phantom at 105 in FIG. 12. Reclosure is enhanced by suitable interfering components such as rib(s) 103 in the pedestal 92 and groove(s) 104 in the bubble. A positive, audible snap fit closure is thereby provided even after the hermetic seal of the package is broken at the time of initial use. In this embodiment, the hermetic seal can be provided by a simple peel seal at the respective flanges of the bubble and pedestal which face each other when the package is assembled.

It will thus be seen that the present invention provides a new, useful and unique merchandising package for sliced bacon, which package has a number of advantages and characteristics including those pointed out herein and others which are apparent. Preferred embodiments of the invention have been described by way of example, and it is anticipated that modifications may be made to the described form without departing from the spirit of the invention or the scope of the appended claims.

We claim:

1. A shaped, generally rigid synthetic plastic sealed package of bacon, including a set of bacon pieces, the package being reclosable and comprising:

a shaped, generally rigid bubble tray member having a bottom panel, side panels defining a generally upstanding sidewall and an open mouth generally opposite to said bottom panel, said open mouth being defined between said generally upstanding sidewall and a tray member peripheral flange, said bubble tray member having transparency properties to permit inspection therethrough of an order set of bacon pieces within the tray member;

a shaped, generally rigid pedestal cover member secured onto said tray member, said pedestal cover member having a cover pedestal panel, a cover member peripheral flange, and a peripheral inset portion joining said cover pedestal panel and said cover member peripheral flange, said peripheral inset portion being substantially parallel to the generally upstanding sidewall of the tray member, and said pedestal cover panel being spaced from said cover member peripheral flange;

said bottom panel of the bubble tray member, said sidewall of the bubble tray member, and said cover pedestal panel of said pedestal cover member are sized and shaped for enclosing therewithin said ordered set of bacon pieces;

said ordered set of bacon pieces engages inside walls of both of said bubble tray member and of said pedestal cover member, and each one of said bacon pieces is supported by said inside surfaces directly or indirectly through others of said bacon pieces to thereby substantially maintain said ordered set of bacon pieces in a configuration which had been determined at the time the package was filled and sealed;

means for releasably hermetically sealing together said tray member peripheral flange to said cover member peripheral flange to provide a sealed package containing said ordered set of bacon pieces; and said sealed package having said ordered set of bacon pieces is gas flushed.

2. The packaged bacon in accordance with claim 1, wherein said ordered set of bacon pieces comprises at least two separate arrays of bacon strips generally stacked one upon another.

3. The packaged bacon in accordance with claim 2, each said array has its bacon pieces arranged in longitudinal side-by-side relationship with each other, and a flexible sheeting is positioned between adjacent ones of said arrays, said sheeting having a surface area at least equal to that of said array of bacon pieces.

4. The packaged bacon in accordance with claim 1, wherein said generally upstanding sidewall of the bubble tray member includes a peripheral ledge portion and a peripheral end portion which further define said bubble tray member mouth, said peripheral end portion being sized and shaped so as to receive therewithin said peripheral inset portion of the pedestal cover member.

5. The packaged bacon in accordance with claim 1, further including ribs within said generally upstanding sidewall of the bubble tray member.

6. The packaged bacon in accordance with claim 1, wherein said bottom panel of the bubble tray member has a planar pedestal portion which is indented with respect to the rest of said bottom panel, and said set of bacon pieces has a total height which is equal to or greater than the vertical distance between said cover panel and said indented planar pedestal portion when said package is closed and before any outward movement of either said indented planar pedestal portion or said bottom panel caused by said set of bacon pieces.

7. The packaged bacon in accordance with claim 5, wherein said bottom panel of the bubble tray member a planar pedestal portion which is indented with respect to the rest of said bottom panel, and said set of bacon pieces has a total height which is equal to or greater than the vertical distance between said cover pedestal panel and said indented planar pedestal portion when said package is closed and before any outward movement of either said indented planar pedestal portion or said bottom panel caused by said set of bacon pieces.

8. The packaged bacon in accordance with claim 1, wherein said pedestal cover member is substantially non-transparent and includes a header area.

9. The packaged bacon in accordance with claim 8, wherein said header area includes a member for suspending said package at a display location.

10. The packaged bacon in accordance with claim 8, wherein said header area has a width less than that of said pedestal cover member.

11. The packaged bacon in accordance with claim 8, wherein said bubble tray member also includes a header area.

12. The packaged bacon in accordance with claim 1, wherein said bacon pieces are at least partially cooked.

13. The packaged bacon in accordance with claim 1, wherein said bacon pieces are uncooked.

14. The packaged bacon in accordance with claim 1, wherein at least a portion of one of said bubble tray member peripheral flange or pedestal cover member peripheral flange extends beyond a corresponding portion of the other of said peripheral flanges.

15. The packaged bacon in accordance with claim 1, wherein said means for releasably hermetically sealing together said tray member peripheral flange to said cover member peripheral flange includes a pull strip by which a portion of one of said peripheral flanges is peeled from the other peripheral flange and removed for unsealing said package.

16. The packaged bacon in accordance with claim 1, wherein said means for releasably hermetically sealing together said tray member peripheral flange to said cover member peripheral flange includes releasable adhesive at said flanges.

17. The packaged bacon in accordance with claim 1, wherein said means for releasably hermetically sealing together said tray member peripheral flange to said cover member peripheral flange includes a permanent hermetic seal and a grasping member for breaking said permanent hermetic seal in order to open said package.

18. The packaged bacon in accordance with claim 4, wherein said peripheral inset portion of the cover member includes means for interfering with at least a portion of said generally upstanding sidewall of the tray member at a location generally along said peripheral end portion of the tray member.

19. A sealed package containing arrays of bacon pieces therewithin, the package being hermetically sealed and reclosable, the package comprising:

a shaped, generally rigid bubble tray member having a bottom panel, side panels defining a generally upstanding sidewall and an open mouth generally opposite to said bottom panel, said open mouth being defined between said generally upstanding sidewall and a tray member peripheral flange, said tray member having transparency attributes to permit inspection therethrough of bacon within the tray member;

a shaped, generally rigid pedestal cover member secured onto said tray member, said cover member having a cover panel, a cover member peripheral flange, and a peripheral inset portion joining said cover panel and said cover member peripheral flange, said peripheral inset portion being substantially parallel to the generally upstanding sidewall of the tray member, and said cover panel being spaced from said cover member peripheral flange;

at least two separate arrays of bacon pieces, said separate arrays of bacon pieces being stacked one upon another and sealed within said package such that substantial portions of said bacon pieces are visible through respective package panels;

said bottom panel of the bubble tray member, said sidewall of the bubble tray member, and said cover panel of said pedestal cover member are sized and shaped for enclosing therewithin said arrays of bacon pieces;

said arrays of bacon pieces engage inside surfaces of both of said bubble tray member and of said pedestal cover member, and each of said arrays is supported by said inside surfaces directly or indirectly through others of said arrays to thereby substantially maintain said arrays of bacon pieces in a which had been determined at the time the package configuration which had been determined at the time the package was filled and sealed;

a flexible sheeting positioned between adjacent ones of said arrays, said sheeting having a surface area at least equal to that of said array of bacon pieces; and means for releasably hermetically sealing together said tray member peripheral flange to said cover member peripheral flange.

20. The packaged bacon in accordance with claim 19, wherein each of said bubble tray member bottom panel and upstanding sidewalls and pedestal cover member cover panel are substantially transparent.

21. The packaged bacon in accordance with claim 19, wherein said generally upstanding sidewall of the bubble tray member includes a peripheral ledge portion and a peripheral end portion which further define said tray member mouth, said peripheral end portion being sized and shaped so as to matingly engage said peripheral inset portion of the pedestal cover member.

22. The packaged bacon in accordance with claim 19, wherein said bacon pieces are at least partially cooked.

23. The packaged bacon in accordance with claim 19, wherein said bacon pieces are uncooked.

24. The packaged bacon in accordance with claim 19, wherein said bottom panel of the bubble tray member has a planar pedestal portion which is indented with respect to the rest of said bottom panel, and said arrays and sheeting have a total height which is equal to or greater than the vertical distance between said cover panel and said indented planar pedestal portion when said package is closed and before any outward movement of either said indented planar pedestal portion or said bottom panel caused by said arrays and sheeting.

25. The packaged bacon in accordance with claim 19, wherein said sealed package is gas flushed.

26. The packaged bacon in accordance with claim 19, wherein at least a portion of one of said tray member peripheral flange or cover member peripheral flange extends beyond a corresponding portion of the other of said peripheral flanges.

27. The packaged bacon in accordance with claim 19, wherein said means for releasably hermetically sealing together said bubble tray member peripheral flange to said pedestal cover member peripheral flange includes a pull strip by which a portion of one of said peripheral flanges is peeled from the other peripheral flange and removed for unsealing said package.

28. The packaged bacon in accordance with claim 19, wherein said means for releasably hermetically sealing together said bubble tray member peripheral flange to said pedestal cover member peripheral flange includes releasable adhesive at said flanges.

29. The packaged bacon in accordance with claim 19, wherein said means for releasably hermetically sealing together said bubble tray member peripheral flange to said pedestal cover member peripheral flange includes a permanent hermetic seal and a grasping member for breaking said permanent hermetic seal in order to open said package.

30. The packaged bacon in accordance with claim 21, wherein said peripheral inset portion of the pedestal cover member includes means for interfering with at least a portion of said generally upstanding sidewall of the bubble tray member at a location generally on said peripheral end portion of the tray member.

* * * * *

UNITED STATES PATENT AND TRADEMARK OFFICE

CERTIFICATE OF CORRECTION

PATENT NO. : 5,795,604

DATED : August 18, 1998

INVENTOR(S) : Cindie M. Wells; Mark E. Selz.

It is certified that error appears in the above-identified patent and that said Letters Patent is hereby corrected as shown below:

On the Cover Page, under "References Cited, U.S. Patent Documents", Patent No. 4,879,328, should read --4,879,128--;
delete "WIPO" and insert --U.K.--;

Col. 5, line 34, delete "peel ability" and insert-peelability--;
line 42, delete "peel ability" and insert --peelability--;
Col.7, line 21, delete "to";
Col. 9, line 17, delete "order" and insert --ordered--;
Col. 11, line 33, delete "which had been determined at the time the package".

Signed and Sealed this

Twenty-eighth Day of March, 2000

*Attest:*

Q. TODD DICKINSON

*Attesting Officer*

*Commissioner of Patents and Trademarks*